US005259451A

United States Patent [19]

Kent et al.

[11] Patent Number: 5,259,451

[45] Date of Patent: Nov. 9, 1993

[54] DOWN HOLE WELL TOOL WITH PRESSURE RELIEF CHAMBER

[75] Inventors: Richard Kent, Barnard Castle, England; Christopher E. Cunningham, Dalgety Bay, Scotland

[73] Assignee: FMC Corporation, Chicago, Ill.

[21] Appl. No.: 914,672

[22] Filed: Jul. 16, 1992

[30] Foreign Application Priority Data

Oct. 4, 1991 [GB] United Kingdom ..... 9121267

[51] Int. Cl.[5] ..... E21B 34/14

[52] U.S. Cl. ..... 166/163; 166/154; 166/318; 166/324; 166/332

[58] Field of Search ..... 166/318, 324, 332, 163, 166/348, 208, 154, 156, 155

[56] References Cited

U.S. PATENT DOCUMENTS

| | | | |
|---|---|---|---|
| 3,273,649 | 9/1966 | Tamplen | 166/332 |
| 3,552,718 | 1/1971 | Schwegman | 166/332 X |
| 3,581,819 | 6/1971 | Tamplen | 166/332 |
| 4,278,131 | 7/1981 | Jani | 166/332 |
| 4,645,006 | 2/1987 | Tinsley | 166/318 X |
| 4,760,884 | 8/1988 | Haugen et al. | 166/163 X |
| 5,062,481 | 11/1991 | Gullett | 166/155 X |
| 5,183,114 | 2/1993 | Mashaw, Jr. et al. | 166/332 X |

*Primary Examiner*—Hoang C. Dang

*Attorney, Agent, or Firm*—Lawrence Cruz; Richard B. Megley

[57] ABSTRACT

A down hole well tool for use in operating another well tool against the resistance of incompressible well bore fluid. The down hole tool includes a pressure chamber that communicates through an adjustable pressure relief valve with the well bore fluids beneath the tool, so that when the pressure of said fluids exceeds the relief valve setting the valve opens and allows said fluids to pass into the chamber, thereby lowering the fluid pressure beneath the tool and facilitating its downward movement to actuate the other well tool.

9 Claims, 1 Drawing Sheet

DOWN HOLE WELL TOOL WITH PRESSURE RELIEF CHAMBER

BACKGROUND OF THE INVENTION

This invention relates to well apparatus, and more particularly to down hole oil tools that seal-in the liquid filled well bore.

During the development of an oil or gas well, various down hole tools are employed, some of which engage moveable sleeves within the well bore. The tools both seal to and lock onto the sleeve, and the sleeve is itself dynamically sealed to the well bore. The function of the tool is to move the sleeve downward.

Conventional practice is to drop a tool in the form of a blank dart down the well bore, where it engages the sleeve. Hydraulic pressure is then applied to the liquid above the dart to move it and the sleeve downward. If the column of liquid below the tool is large enough, the sleeve can be satisfactorily moved the required distance. However, if there is a plug closely below the landed dart, the volume of incompressible fluid in the resulting blind chamber establishes a pressure lock preventing the dart from shifting the sleeve or other down hole tool mechanism, thereby defeating the functional requirement of the system.

SUMMARY OF THE INVENTION

The invention overcomes the above and other problems by providing a sealed chamber of air as an integral part of a down hole tool, and a pressure relief valve in the tool to control flow of liquid from beneath the tool into the chamber. The tool seals in the well bore, thereby separating the liquid below the tool from that above it. When pressure above the tool is increased, the tool moves downward a very short distance until the pressure below it equals the pressure above. When this pressure reaches a predetermined value, the relief valve opens and allows flow of liquid from beneath the tool into the air chamber, resulting in compression of the air and reduction of the pressure of the liquid below the tool. As pressure above the tool becomes greater than the pressure below it, the tool moves downward to perform its intended function.

The invention is particularly useful when the tool is moving towards the bottom of a plugged hole and the column of liquid below the tool is short. The invention can be used at widely varying water depths by pre-setting the relief valve to open at a chosen pressure. Also, the invention is not normally limited by external factors such as type of liquid, chemical environment or temperature.

DESCRIPTION OF THE PREFERRED EMBODIMENT

Figure 1:
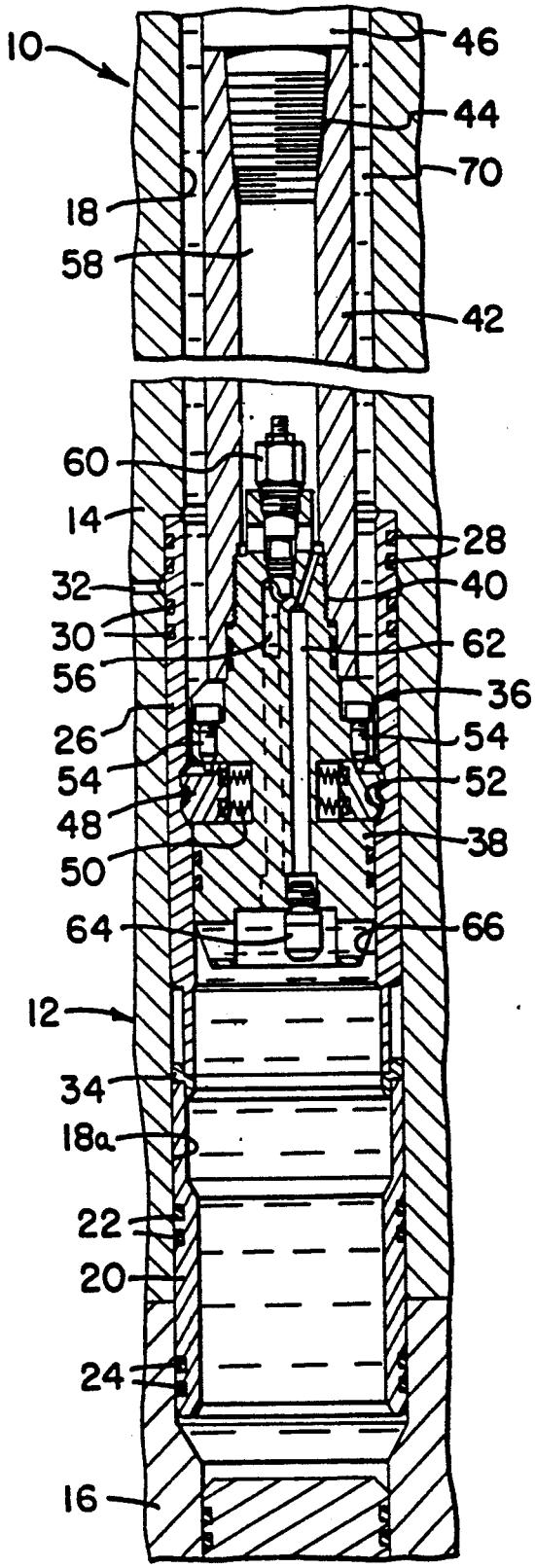
FIG. 1 is a fragmentary central vertical section of a tubing hanger running tool embodying the present invention, the tool shown in a well bore before it is pressurized to move a sleeve valve downward.

As illustrated in FIG. 1, a tubing hanger running tool 10 in accordance with the present invention has a tool body 12 with a body portion 14 that, in use, is securely interconnected by suitable means (not shown) to a tubing hanger 16. The tool body 12 has a central bore 18 with an enlarged diameter portion **18*a* in which a seal sleeve 20, with upper and lower sets of annular sealing elements 22, 24, is located to provide a pressure seal between the tool body 12 and the tubing hanger 16. Above the seal sleeve 20 is a sleeve valve 26, also residing in the enlarged bore 18*a*, with upper and lower sets of annular sealing elements 28, 30 which seal the sleeve valve 26 to the enlarged bore 18*a* and close a hydraulic port 32 in the body portion 14** when the sleeve is in the position shown.

The sleeve valve 26 is retained in its upper position by a shear ring 34 between the lower end of the sleeve valve and upper end of the seal sleeve 20. When open, the hydraulic port 32 inlets pressure from the bore of the well's production pipe string to operate a secondary release mechanism (not shown) for the running tool 10, and therefore requires a closure element, herein the sleeve valve 26, to control that operation. This operation causes a release of the running tool 10 from the tubing hanger 16 in the event of failure of the primary hydraulic system, thereby assuring that tool/hanger release and tool retrieval are possible.

To accomplish this secondary release by moving the sleeve valve 26 to its lower position (FIG. 2) whereby the port 32 is open, a secondary release mechanism 36 is employed. This mechanism 36 includes a main body 38 suitably connected, as by threads 40, to the lower end of an air pipe element 42, the upper end of which element is connected by threads 44 to the lower end of a drill pipe solid sub 46. The main body 38 is releasably connected to the sleeve valve 26 by a plurality of circumferentially spaced setting dogs 48 (two shown) which are biased outwardly by spring 50 into an inner groove system 52 in the sleeve valve 26, and dog-point cap screws 54 retain the dogs 48 in the main body 38.

A first longitudinal passageway 56 extends through the main body 38 to provide communication between the outside of the body and the interior of the air pipe 42, this interior forming an air chamber 58 used to facilitate venting of the enclosed volume of liquid beneath the main body 38. At the upper end of the passageway 56 is a relief valve 60 which can be set to open at a predetermined pressure exerted against it through the passageway 56. A second longitudinal passageway 62 through the main body 38 communicates between the air chamber 58 and a bleeder plug assembly 64 at the lower end of the main body, thereby providing a means to vent pressure in the air chamber and drain it of all liquid after the tool has been used and retrieved to the surface.

Figure 2:
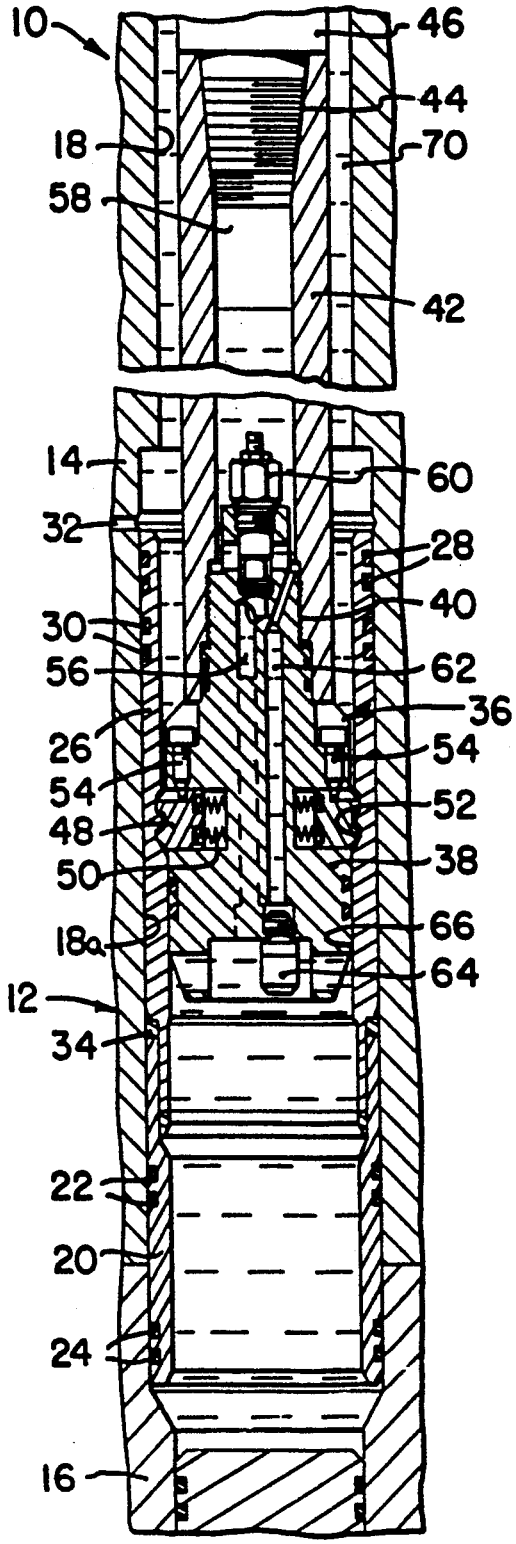
FIG. 2 is a view like FIG. 1, but showing the tool after pressurization and downward movement of the sleeve valve.

In operation, the secondary release mechanism 36 is run on wire line until its main body 38 lands in the sleeve valve 26 of the tubing hanger running tool 10, and at this position the main body 38 seals off the bore 66 in the sleeve valve 26. Pressure is applied to the production bore, which pressure is conducted through the annulus 70 (between the running tool bore 18 and the solid sub 46) and air pipe 42 to the main body 38 to force the mechanism 36 downward. The pressure of the liquid below the main body 38 then also increases, having the effect of preventing its further downward motion. When the pressure below the main body 38 rises to a predetermined value, the relief valve 60 opens and the liquid below the tool flows into the air chamber 58. The effect of the liquid flow is to reduce the pressure in the bore beneath the tool, and the main body 38, air pipe 42, solid sub 46 and sleeve valve 26 move downward, shearing the ring 34. This downward movement continues until the sleeve valve 26 comes to rest on the seal sleeve 20, with a portion of the shear ring 34 therebetween and the port 32 open, all as seen in FIG. 2.

When the secondary release tool 36 is returned to the surface, the air chamber 58 contains liquid at high pressure (dependent upon the depth of the well). This pressure is released, and the liquid drained, by opening the bleed valve 64 prior to disassembly of the tool for cleaning and preparing it for its next use.

Although the best mode contemplated for carrying out the present invention has been herein shown and described, it will be apparent that modification and variation may be made without departing from what is regarded to be the subject matter of the invention.

What is claimed is:

1. A well apparatus for use down-hole to operate a well tool against the resistance of incompressible well bore fluid, said apparatus comprising a main body with means for connection to said well tool; means to seal the main body to a bore in said well tool; an air chamber for receiving and containing air and incompressible well bore fluid; first and second fluid passageways through said main body, said passageways providing communication between the air chamber and the outside of the main body beneath the seal means; pressure releif means in the first passageway for facilitating venting of incompressible well bore fluid sealed off below said main body; closable vent means in the second passageway to vent air and fluid pressure and drain well bore fluid out through the lower end of said main body after said tool has been used; and means to connect said apparatus to a tool running means for running said apparatus into a well.

2. Well apparatus according to claim 1, wherein the pressure relief means comprises a check valve which opens to allow fluid flow from outside and beneath said apparatus into said air chamber.

3. Well apparatus according to claim 2, wherein said check valve is adjustable to a predetermined pressure.

4. Well apparatus according to claim 1, wherein the vent means can be opened to allow fluid flow from said air chamber to the atmosphere.

5. Well apparatus according to claim 1, wherein the air chamber is defined by a length of pipe extending up from a sealed connection to said main body.

6. Well apparatus according to claim 5, wherein the upper end of said pipe is connected to a drill pipe solid sub which provides a closure for said chamber.

7. Well apparatus according to claim 1, wherein the means for connection to said well tool comprises a plurality of spring-biased dogs which cooperate with an annular groove in said tool.

8. Well apparatus according to claim 1, wherein the well tool comprises a tubing hanger running tool.

9. Well apparatus according to claim 8, wherein the running tool comprises a sleeve valve to which said apparatus is connected for movement thereof against well bore fluid pressure.

* * * * *